US005953867A

United States Patent [19]

Colletto

[11] Patent Number: 5,953,867

[45] Date of Patent: Sep. 21, 1999

[54] SEAL ARRANGEMENT FOR A SWIMMING-POOL LINING STRUCTURE

[75] Inventor: Giorgio Colletto, Mantova, Italy

[73] Assignee: A & T Europe S.p.A., Mantova, Italy

[21] Appl. No.: 08/940,938

[22] Filed: Sep. 30, 1997

[30] Foreign Application Priority Data

Oct. 9, 1996 [IT] Italy ..... MI960668 U

[51] Int. Cl.[6] ..... E04H 4/00

[52] U.S. Cl. ..... 52/169.7; 4/506

[58] Field of Search ..... 52/169.7, 469, 52/408; 4/506

[56] References Cited

U.S. PATENT DOCUMENTS

| | | | |
|---|---|---|---|
| 3,177,501 | 4/1965 | Kwake | 52/169.7 |
| 3,419,916 | 1/1969 | Schankler | 52/169.7 |
| 3,681,885 | 8/1972 | Goggins | 52/469 |
| 4,004,386 | 1/1977 | Diffenderfer | 52/169.7 |
| 4,655,099 | 4/1987 | DeGraan | 52/469 |
| 5,067,228 | 11/1991 | Gardenier | 52/169.7 |

*Primary Examiner*—Carl D. Friedman
*Assistant Examiner*—Dennis L. Dorsey
*Attorney, Agent, or Firm*—Hedman, Gibson & Costigan, P.C.

[57] ABSTRACT

A seal arrangement for a swimming-pool lining structure which is intended to be placed against the walls and bottom of a swimming-pool. The lining structure has metal wall panels and base sheets coated with plastic material on the surface facing the interior of the swimming-pool. The metal wall panels and the base sheets are jointed together with a profiled connection element at the vertical edge of each of the wall panels to form a junction region. The junction regions between said profiled connection elements and the ends of said wall panels and of said base sheets have an associated fluid plastic paste compatible with the wall panels.

6 Claims, 2 Drawing Sheets

SEAL ARRANGEMENT FOR A SWIMMING-POOL LINING STRUCTURE

This invention relates to a seal arrangement for a swimming-pool lining structure.

Certain already existing swimming-pools, especially those of concrete construction but also swimming-pools of other type, sometimes need to be lined because of leakages or other problems. The lining must not however be bulky otherwise the swimming-pool dimensions become decreased. For example, this requirement is very important and unwavable in the case of swimming-pools used for competitions in which their exact length is an essential element. Hence the lining must be a very small thickness, to enable the required length to be respected.

It must also be noted that normal linings are fixed by bolts or other elements which can result in leakages through the holes provided in the lining for its fixing. This problem must therefore also be considered involving the existing problems. The object of the present invention is to provide a seal arrangement for swimming-pool restructuring, which eliminates these drawbacks by virtue of its small dimensions, and which also minimized the danger of seepage and leakages.

According to the invention, this object is attained by a seal arrangement for a swimming-pool lining structure, comprising metal panels and base sheets coated with plastic material at least on that surface facing the interior of the swimming-pool basin, characterised in that in the junction regions between adjacent panels or between panels and base sheets there is provided a profiled connection element, between said profiled connection element and the ends of said panels and of said sheets there being associated a fluid plastic paste compatible with them and sealedly bondable to them, for swimming-pool restructuring.

The characteristics and advantages of a seal arrangement for swimming-pool restructuring according to the present invention will be more apparent from the following description given by way of non-limiting example with reference to the schematic accompanying drawings, on which:

The figures generally show parts of a swimming-pool in terms of portions of its concrete structure 11, which are lined on its walls 12 with plastic-coated metal plate panels, and along its base with sheets 13 of equivalent plastic material. The metal plate can be of stainless steel, galvanized or painted steel, aliminium or other suitable metal. The metal plate can be plastic-coated, for example with sheet PVC or another plastic material with bonding characteristics. This bonding operation must preferably be able to be accomplished with a fluid plastic paste which joins two adjacent coating sheets together. In any event, at least that surface facing the interior of the swimming-pool basin must be coated with plastic material.

Figure 1:
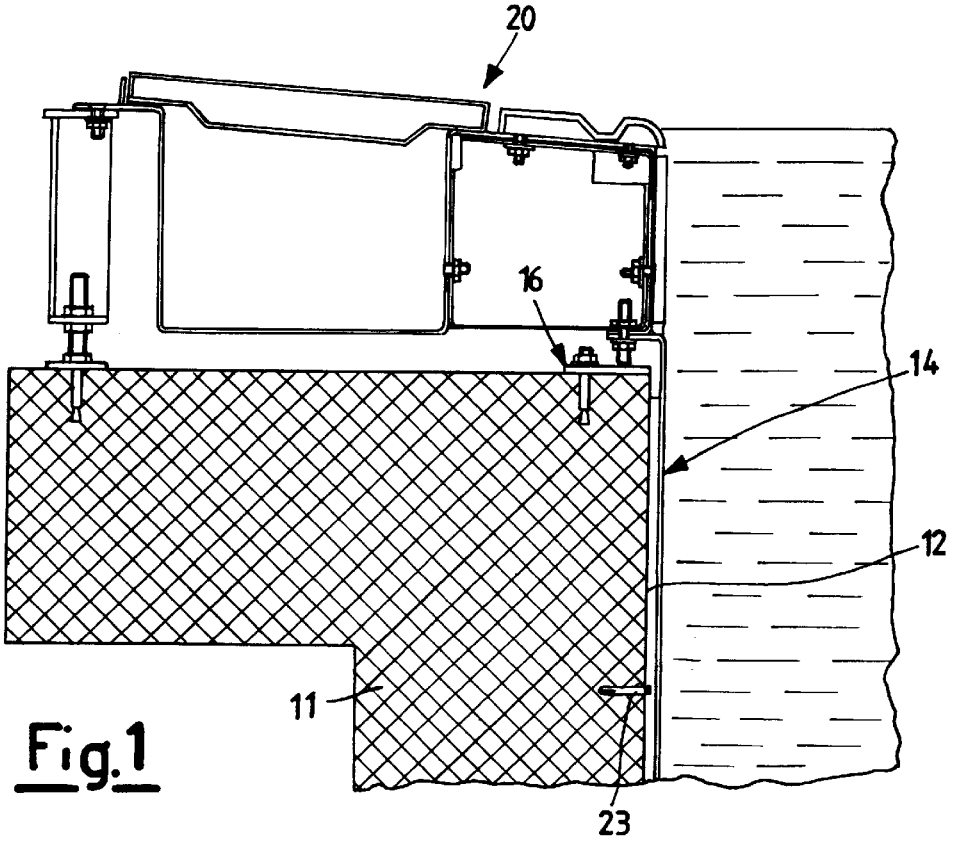
FIG. 1 is a partly sectional schematic view of an upper corner and a vertical side wall of a swimming-pool, for which a seal arrangement according to the invention is provided.
Figure 2:
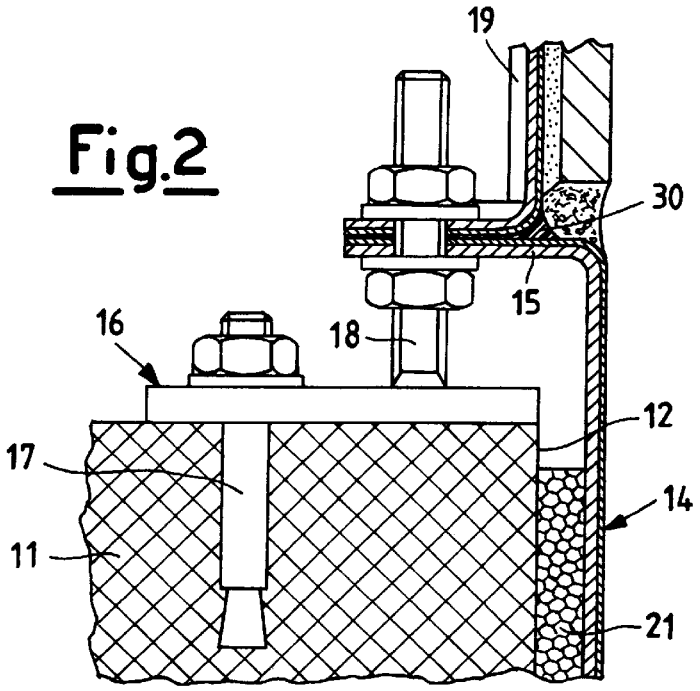
FIG. 2 is an enlarged view of a detail of FIG. 1.

FIGS. 1 and 2 show an upper corner 11 of a swimming-pool, shown in section, with a vertical side wall 12 thereof there being associated a lining having a seal arrangement according to the invention.

More specifically, it can be seen that several panels 14, of which only one is shown in FIGS. 1 and 2, extend from the base of the swimming-pool towards the edge of the upper corner. The panels 14 terminate with a flange 15 or other fixing element facing the overflow edge of the corner to be lined.

At this corner, for example, there can be fixed an adjustment plate 16, secured to the concrete by plugs 17, to which studs 18 are secured to be inserted into holes in the flange 15 and in a subsequent strengthening bracket 19, and be locked thereat by nuts and locking nuts.

To the bracket 19 there can be fixed an overflow edge structure, indicated overall by 20, provided on its surface with tiles or the like. A compatible and bondable fluid plastic paste 30 can be provided in this terminal portion of the vertical wall 12, in correspondence with the connection between the panel 14 and the overflow edge structure 20.

The panels 14, which cover the vertical side walls 12 and an insulating and filling material 21, are fixed to the walls by being inserted into a profiled junction bar or retainer element, the joint then being made impermeable by a seal formed from fluid plastic paste. In addition, to improve the seal, a labyrinth configuration is provided to receive and retain the fluid sealant material in paste form poured into it.

Figure 3:
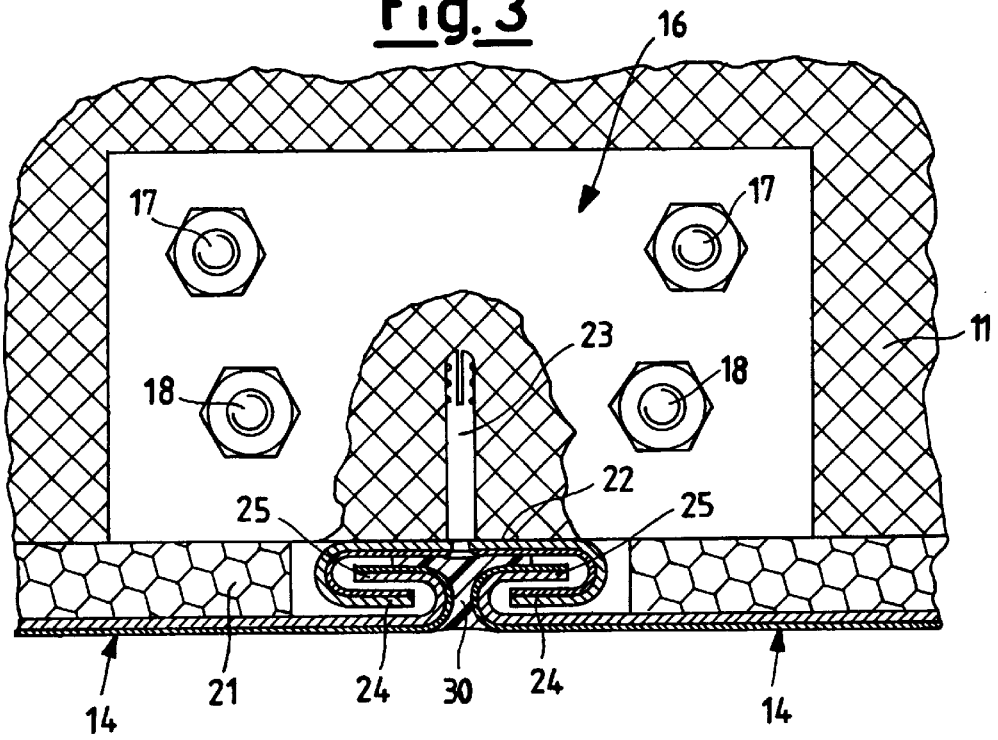
FIG. 3 is a partly sectional enlarged view from above showing a further detail of FIG. 1 in correspondence with an element for its fixing to the vertical wall.

FIG. 3 shows on an enlarged scale how a retainer element 22 is fixed to the wall by a plug 23 inserted into the intermediate part and penetrating into the masonry of the vertical wall 12. The retainer element 22 has curved ends 24 and is of omega or C-shape. It can be in the form of a vertical section bar acting as the connection element between the panels.

Along its long vertical sides, each panel 14 has curved ends 25 bent so that they penetrate into the opposing ends 24 of the retainer element 22 in a co-penetrating manner. The retainer element 22 must carry, at least on its opposite ends 24, plastic-coated portions compatible both with the fluid sealant product in paste form and with the plastic material lining the panels. The seal arrangement is hence achieved in that two plastic-coated surfaces face each other and can be bonded together by a suitable paste 30, which in the example is fluid PVC. Moreover for an improved finish, the paste 30 can be of the same colour as the plastic coating of the panels.

Hence on the junction regions a seal arrangement is formed which is not only perfectly impermeable but also sufficiently elastic. The provision of several fixing plugs 23 for the retention element 22 prevents swelling or bulging of the panels along the wall, so obtaining a perfectly flat surface as far as the upper overflow edge.

Figure 4:
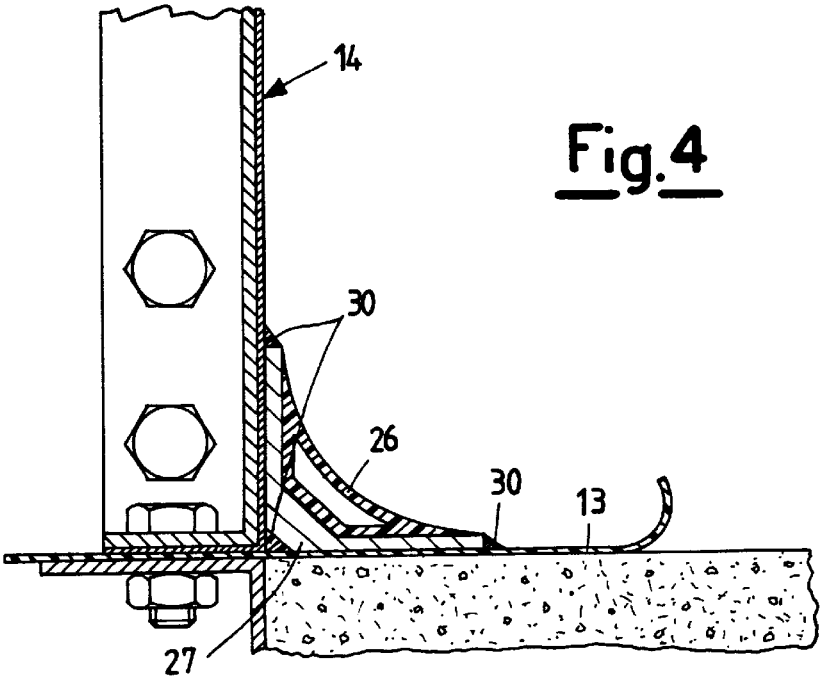
FIG. 4 is a sectional detail of a seal arrangement at a lower corner between a vertical side wall of the swimming-pool and its base.

A seal arrangement according to the present invention must also be provided between the vertical wall 12 where the panels 14 are positioned, and the base where sheets 13 of plastic material equivalent to the panel coating material are located. To provide this arrangement, the connection element used between the panels and base is a suitable angular section bar 26, such as that shown in FIG. 4.

The angular section bar 26 is formed of a plastic material compatible both with lining of the wall panels and with the sheet material located on the base. The angular section bar 26 is previously fixed by a suitable solvent both to the lining part of the panel 14 and to the sheet 13 located on the base, as shown schematically at 27 in FIG. 4, or simply by fusing together the facing surfaces of compatible material by means of hot air.

As in the aforedescribed arrangement provided along the vertical joints between the wall-covering panels, in order to improve the seal, the aforesaid fluid sealant product 30 is paste form is applied in the outer connection regions and to the ends of the angular section bar 26.

It can therefore be seen that by means of the seal arrangement of the present invention, linings can be formed which enable the dimensions of the swimming-pool basin to be maintained unchanged, given the extreme narrowness of the lining and the fact that the retention joint can be embedded in the wall to be lined, so that the original size of the basin is reduced only by the thickness of the panel 14.

Advantageously, the provision of a section bar and of a fluid sealant product in paste form compatible with the base panel coatings means that a considerable guarantee of basin impermeability can be achieved. The nature of the sealant material and the particular structure of the profiled elements which cooperate with it form a sufficiently elastic joint able to absorb and tolerate temporary structure variations determined by pressure change due to the water or the lack of it, or by temperature.

I claim:

1. A seal arrangement for a swimming-pool lining structure adapted to be placed against the walls and bottom of a swimming-pool, said lining structure comprising metal wall panels and base sheets coated with plastic material at least on that surface which will face the interior of the swimming-pool basin, said metal wall panels and said base sheets being joined together with a first profiled connection element where said wall panels meet said base sheets to form a first junction region and said metal wall panels which are adjacent to one another being jointed to one another at the vertical edge of each of said wall panels with a second profiled connection element to form a second junction region wherein said junction regions between said profiled connection elements and the ends of said wall panels and of said base sheets there being associated a fluid plastic paste compatible with said wall panels and said base sheets and sealedly bondable to said wall panels and said base sheets.

2. A seal arrangement as claimed in claim 1, characterized in that said second profiled connection element between said wall panels which are adjacent consists of a retention element having curved ends, said curved ends being oriented towards the walls of a swimming-pool in which said wall panels are to be installed, said curved ends being arranged to cooperated with curved ends which are on the vertical edge of each of said wall panels.

3. A seal arrangement as claimed in claim 2, characterized in that said retention element is omega or C-shaped.

4. A seal arrangement as claimed in claim 1, characterized in that said connection between wall panels and base sheets comprises an angular section bar.

5. A seal arrangement as claimed in claim 1, in that each of said wall panels comprises a flat vertical portion and a flange-type fixing portion for fixing to an upper wall edge of a swimming-pool.

6. A seal arrangement as claimed in claim 5, in that said flange-type fixing portion is for fixing to an upper wall edge of a swimming-pool by way of an interposed adjustment plate carrying a terminal portion of said wall panel, said flange-type fixing portion being provided with a compatible and bondable fluid plastic paste.

* * * * *